United States Patent [19]

Demmer et al.

[11] Patent Number: 5,021,621

[45] Date of Patent: Jun. 4, 1991

[54] MICROWAVE OVEN HAVING INTEGRAL MIXING ASSEMBLY

[76] Inventors: Martha Demmer, R.D. No. 1, Box 28; Thomas Talboys, P.O. Box 189, both of Montrose, Pa. 18801

[21] Appl. No.: 510,179

[22] Filed: Apr. 17, 1990

[51] Int. Cl.[5] ..... H05B 6/80

[52] U.S. Cl. ..... 219/10.55 F; 219/10.55 E; 99/348; 99/DIG. 14; 366/146

[58] Field of Search ..... 219/10.55 E, 10.55 F, 219/10.55 M, 10.55 R; 99/348, 451, DIG. 14; 366/146

[56] References Cited

U.S. PATENT DOCUMENTS

| | | | |
|---|---|---|---|
| 4,303,817 | 12/1981 | Klement et al. | 219/10.55 D |
| 4,429,204 | 1/1984 | McGuire et al. | 219/10.55 F |
| 4,751,357 | 6/1988 | Boulard | 219/10.55 F |
| 4,845,327 | 7/1989 | Iwabuchi et al. | 219/10.55 F |
| 4,904,834 | 2/1990 | Bowen | 219/10.55 E |

FOREIGN PATENT DOCUMENTS

| | | | |
|---|---|---|---|
| 2159027 | 11/1985 | United Kingdom | 219/10.55 F |

*Primary Examiner*—Philip H. Leung
*Attorney, Agent, or Firm*—Kenyon & Kenyon

[57] ABSTRACT

The invention provides a microwave oven having an integral mixing assembly for agitating food inside of the microwave chamber during cooking. The mixing assembly includes a mixer shaft which is received through the top microwave chamber wall and which is capable of rotational movement. The mixer shaft is powered for rotational movement by a motor. The end of the mixer shaft disposed inside of the microwave chamber is adapted for releasable connection to one or more stirring or agitating means. A belt drive system and support mechanism are provided to control rotation of the mixer shaft.

10 Claims, 3 Drawing Sheets

MICROWAVE OVEN HAVING INTEGRAL MIXING ASSEMBLY

FIELD OF THE INVENTION

The invention relates to a microwave oven which can cook liquid, semi-liquid and mixable foods such as batters, sauces, stews and the like more evenly than has heretofore been possible. More particularly, the invention relates to a microwave oven having a mixing assembly as an integral part thereof.

BACKGROUND OF THE INVENTION

Microwave cooking is popular as a quick and convenient way of preparing many types of foods. One important characteristic of microwave cooking is that the food cooks from the outside to the inside. It is therefore known that microwave cooking can cook food unevenly such that the center cooks less than the peripheral areas. This may be an advantageous feature in the preparation of certain food products such as meat where it may be desired to serve the product less well done. In addition, the uneven cooking characteristic of microwave ovens has not been a major drawback in the heating of pre-cooked food products, due to differing food densities.

However, the uneven cooking associated with microwave ovens has posed a major problem in the cooking of food products which have not been pre-cooked, such as eggs and sauces. In such instances, the even distribution of heat throughout the food product is crucial to complete and thorough cooking. Uniform cooking is particularly important in the preparation of foods which ordinarily require mixing such as batters, doughs, sauces, stews and the like. Heretofore, microwave cooking has not been particularly suitable for the preparation of such foods which require mixing and a substantially even distribution of heat. At present, the microwave cooking process must be stopped and the oven must be opened so that the food can be stirred. Thus, there is a need for a microwave oven which permits all cooking and stirring operations that might be done on a stove top to be accomplished therein.

Accordingly, it is an object of the invention to provide a microwave mixer which ensures that liquid, semi-liquid and mixable foods are uniformly and completely cooked by mixing the same during the cooking process.

It is a further object of the invention to provide a microwave oven having an integral mixing means for mixing food in the microwave chamber during cooking.

SUMMARY OF THE INVENTION

The invention provides a microwave oven having an integral mixing assembly for agitating food inside of the cooking cavity during cooking, said mixing assembly including a mixer shaft which is received through a cooking cavity wall and which is capable of rotational movement about its longitudinal axis, the mixer shaft being powered for rotational movement by a motor. The end of the mixer shaft disposed inside of the cooking cavity is adapted for releasable connection to one or more stirring or agitating means. Means may be provided for ensuring that harmful amounts of radiation do not leak from the cooking cavity.

DETAILED DESCRIPTION OF THE INVENTION

The invention provides a microwave oven having an integral mixing means for agitating food inside of the microwave chamber. The microwave oven includes a plurality of walls which enclose a microwave chamber or cooking cavity 14. One of the walls is provided with a door (not depicted) for the ingress and egress of food. The microwave oven is conventional in all respects and can be constructed in a well known manner with the exception of the integral mixing means and modifications to accommodate the mixing means which will now be described.

Figure 1:
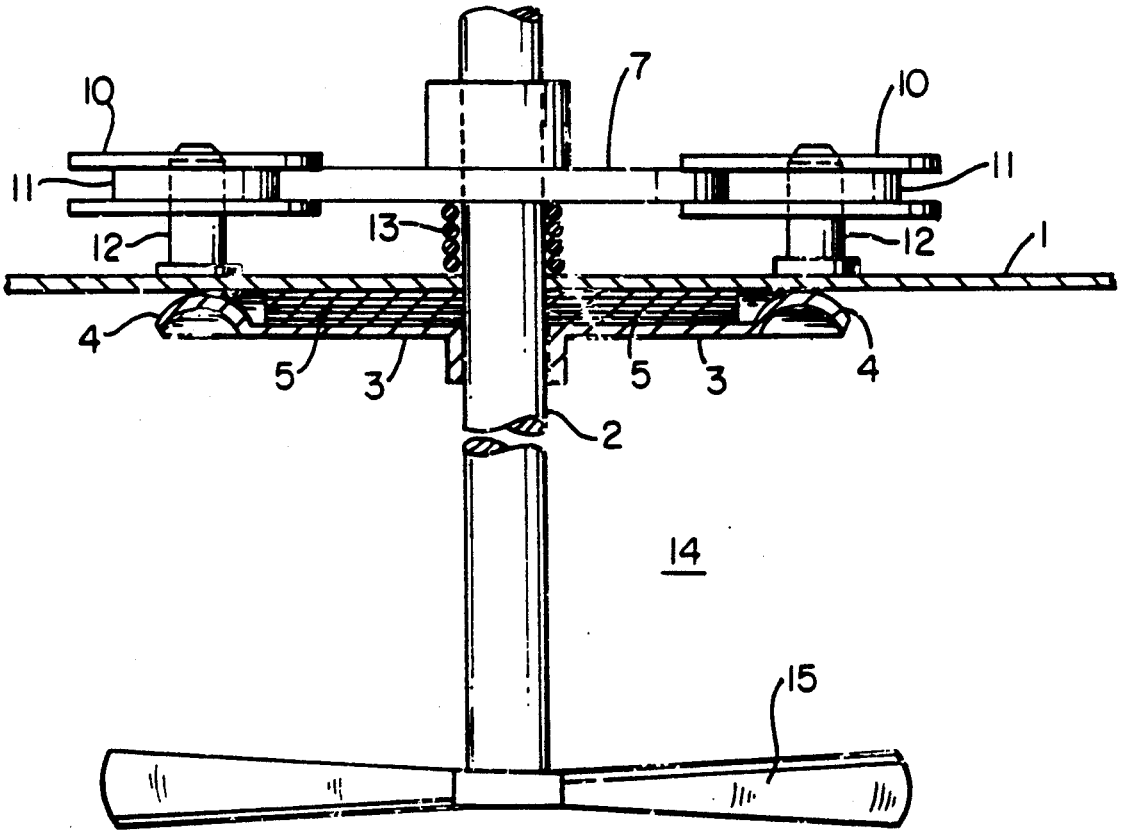
FIG. 1 is a cross-sectional view of the microwave mixer according to the invention.
Figure 3:
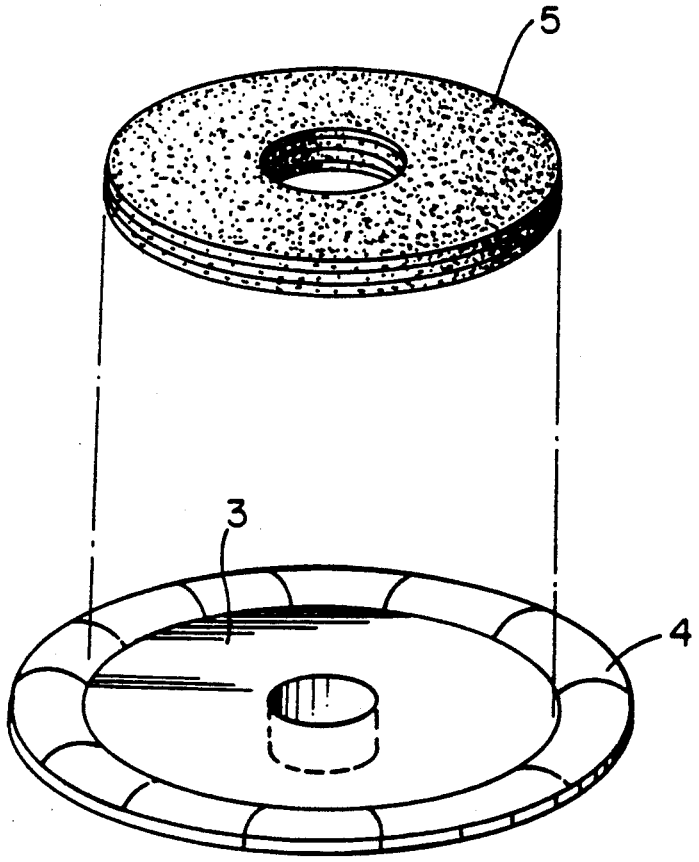
FIG. 3 is an isolated view of the woven metal preform and shield retainer plate used in the microwave mixer to abate or prevent leakage of microwaves from the chamber.

Referring to FIG. 1, the top wall 1 of the microwave chamber is provided with a hole for receiving a mixer shaft 2. As illustrated in FIG. 1 the mixer shaft extends into the microwave chamber 14. The mixer shaft 2 must be capable of rotational movement about its longitudinal axis within the chamber wall 1. Any space between the chamber wall 1 and the mixer shaft 2 which is necessary to permit such rotational movement should be minimized such that the oven is opaque to harmful amounts of microwave radiation to prevent leakage. Alternatively, in order to ensure that harmful amounts of microwaves do not emanate from the microwave chamber 14 in the vicinity of the mixer shaft 2, the invention may be provided with a novel means for abating or preventing leakage of the microwaves. The means for preventing leakage is preferably comprised of a shield retainer plate 3 which is attached around the periphery of the mixer shaft 2 on the inside of the microwave chamber such that it rotates with mixer shaft 2 during operation. The shield retainer plate 3 is disposed on the mixer shaft 2 adjacent to the inside of the wall 1 which receives the mixer shaft. The shield retainer plate 3 has a raised lip 4 (see also FIG. 3) for making continuous loose contact with the inner surface of the chamber wall 1 (see FIG. 1) so as to at least attenuate any microwaves attempting to escape through the border and yet allow for the rotational movement of the shield retainer plate 3. Shield retainer plate 3 and its lip 4 as well as the microwave chamber wall 1 are preferably constructed of stainless steel. The face of retainer plate 3 facing the inside of chamber 14 and the inside of the chamber walls may be coated with a layer of a plastic or polysulfone (not depicted).

The means for preventing leakage also preferably includes a woven metal preform 5 snugly disposed around the periphery of mixer shaft 2 in the space between the top of the shield retainer plate 3 and the inside surface of the microwave chamber wall 1. The woven metal preform 5 is snugly bordered around its periphery by the lip 4 of shield retainer plate 3. The woven metal preform is preferably comprised of densely packed metal (i.e., stainless steel) fibers and filaments such that it is opaque to microwaves thereby preventing leakage.

Thus, it can be seen that in an attempt to escape from the chamber 14 microwaves will first have to traverse the border between the lip 4 of retainer plate 3 and the chamber wall 1. At this border the microwaves will at least be attenuated. If any microwaves manage to cross the border they will be absorbed by woven metal preform 5 which is opaque to harmful amounts of microwaves. Thus, harmful amounts of microwaves cannot escape from the space between the mixer shaft 2 and the microwave chamber wall 1.

The invention includes means for rotating mixer shaft 2. This means would include a motor 6 (see FIG. 2) for powering the rotation in either a direct drive fashion or in a belt drive fashion. Direct drive means which are known in the art can be used. A belt drive system is preferred and the invention provides a novel belt drive system and support means which will now be described.

Figure 2:
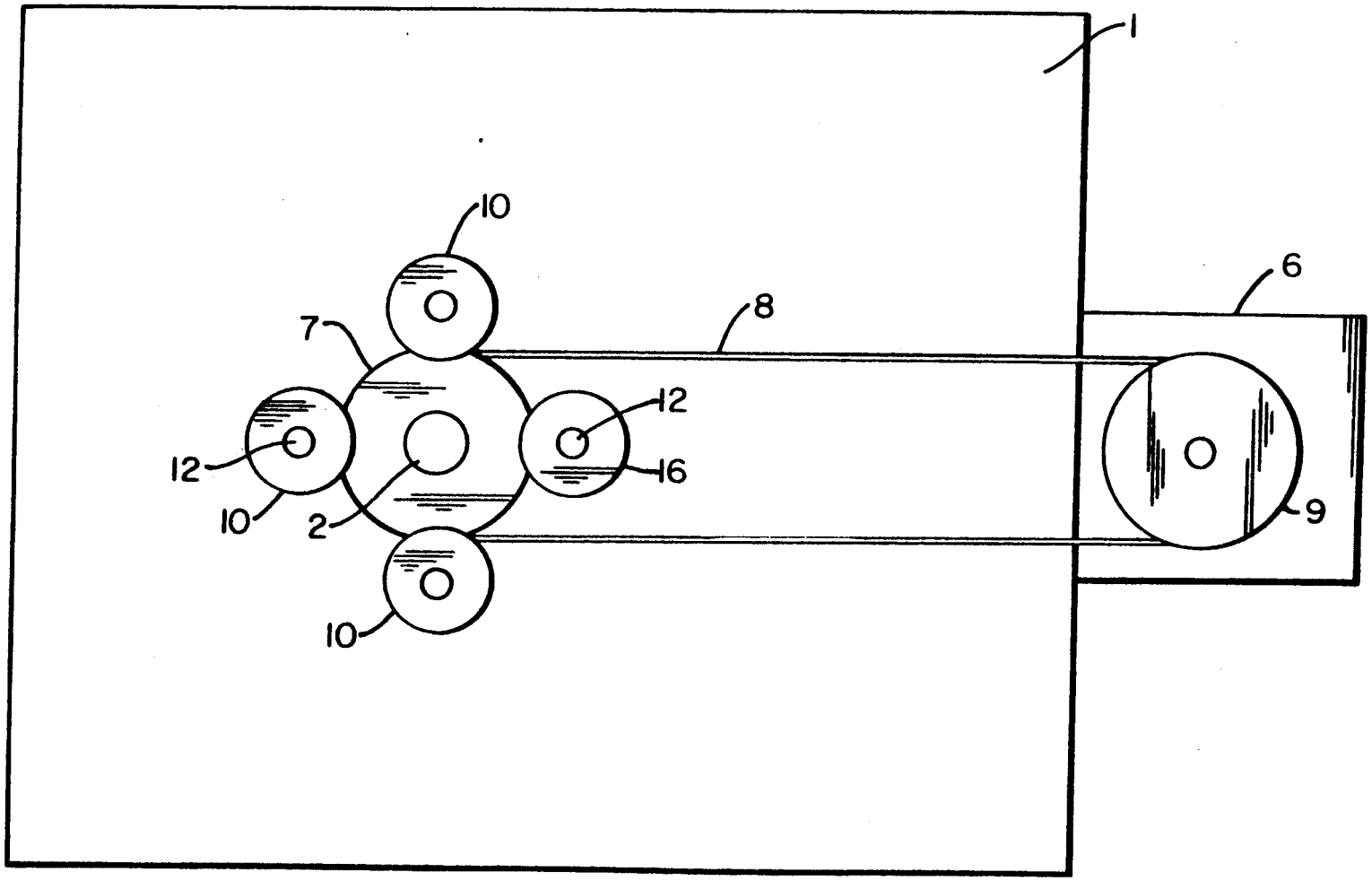
FIG. 2 is a top view of the microwave mixer illustrating drive means for rotating the mixer shaft of the oven.

Referring to FIG. 2, a drive disc 7 is attached around the periphery of mixer shaft 2 on the outside of the oven. Mixer drive disc 7 receives a belt 8 around an arc of its periphery in a tight pulley like manner (see FIG. 2). Belt 8 couples mixer drive disc 7 for rotational movement with a motor drive disc 9 of motor 6.

In this embodiment, mixer drive disc 7 is supported and restricted from all non-rotational movement (i.e., lateral and vertical movement) by a plurality of supports 10, 16 arranged around the periphery of mixer drive disc 7. Supports 10, 16 are constructed like a reel (see FIG. 1) such that the edge of mixer drive disc 7 is sandwiched between the ends of the reel to be restricted from vertical movement. Support reels 10, 16 include a hub 11. Preferably, at least one support reel 16 is positioned directly between mixer drive disc 7 and motor drive disc 9. The periphery of the hub 11 of this support reel 16 abuts the periphery of mixer drive disc 7 to restrict the mixer drive disc 7 (and hence the mixer shaft 2) from lateral movement in the direction of the motor. The periphery of each hub 11 of the other support reels 10 will abut belt 8 around the periphery of mixer drive disc 7 to prevent lateral movement of the mixer drive disc 7 in other directions and to maintain belt 8 around the periphery of mixer drive disc 7.

Each support reel 10, 16 is mounted for rotational movement on a mounting axle 12. Mounting axles 12 are attached in an upright manner to the outside surface of top chamber wall 1. There are preferably two supports 10 and one support 16 around mixer drive disc 7 and most preferably, three supports 10 and one support 16.

It should be appreciated that supports 10, 16 may be ordinary discs rather than reels if mixer drive disc 7 is constructed as a reel. In this alternative embodiment (not depicted): the support discs will be sandwiched by the mixer drive reel to restrict vertical movement of the mixer drive reel, belt 8 will be wrapped around an arc of the hub of the mixer drive reel; and the periphery of the support discs will abut the hub of the mixer drive reel (or the belt around the hub as the case may be) to restrict lateral movement of the mixer drive reel.

Mixer drive disc 7 (and hence mixer shaft 2) may also be supported on one end of a spring 13 which is disposed around mixer shaft 2 (see FIG. 1). The other end of spring 13 rests on the top of chamber wall 1 for supporting the mixer drive disc 7 (and hence the mixer shaft 2).

Various stirrers or other beaters 15 may be attached to the mixer shaft 2 depending upon the type of mixing or blending which is desired during cooking. The stirrer 15 and the portion of the mixer shaft 2 disposed inside the cooking cavity 14 are coated with a plastic or a well known polysulfone coating.

It can be seen from the foregoing description that the invention provides a microwave mixer which allows for the mixing of food in the microwave chamber during cooking. In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are accordingly to be regarded in an illustrative rather than a restrictive sense.

What is claimed is:

1. A microwave mixer comprising:

a top chamber wall;

a plurality of chamber walls which, in conjunction with said top chamber wall, enclose a cooking cavity, one of said chamber walls having a door allowing for ingress of food;

a means for generating microwaves in said cooking cavity;

a mixer shaft received through said top chamber wall and extending into said cooking cavity, said shaft being capable of rotational movement about its longitudinal axis;

mixing means associated with a portion of said mixer shaft disposed inside said cooking cavity;

a motor having an annular rotatable means;

an annular rotatable means coaxially coupled to said mixer shaft for rotating with said shaft;

a belt means for coupling the rotatable means belonging to the shaft for rotational movement with the rotatable means belonging to the motor; and means for supporting said mixer shaft to restrict non-rotational movement thereof, including a plurality of reels disposed around the periphery of the annular rotatable means belonging to the mixer shaft, each reel having a hub, at least one reel hub abutting the periphery of said annular rotatable means and at least one other reel hub abutting said belt means around said annular rotatable means, each of said reels being rotatably mounted on a mounting axle, each mounting axle being mounted upright on the outside of the top chamber wall.

2. A microwave mixer according to claim 1 wherein the means for supporting said shaft further includes a spring disposed around the shaft, one end of the spring resting on the outside of the top chamber wall and the other end of the spring supporting said annular rotatable means belonging to said shaft.

3. A microwave mixer according to claim 1 further comprising a means for abating escape of microwaves comprising a plate disposed alongside the inside of the top chamber wall which receives said shaft, said plate being attached around the periphery of said shaft so that it is rotatable therewith and extending from the periphery in directions parallel to the top chamber wall and said plate having a lip extending completely around the periphery of said shaft, said lip making continuous contact with the top chamber wall thereby enclosing a space between said plate and said top chamber wall.

4. A microwave mixer according to claim 3 wherein the means for abating escape of microwave further comprises a preform of a multiplicity of densely packed metal fibers disposed int eh space enclosed by said plate and the top chamber wall which receives said shaft, said preform being substantially opaque to microwaves generated in the cooking cavity.

5. A microwave mixer according to claim 4 wherein said plate is constructed of stainless steel.

6. A microwave mixer comprising:

a top chamber wall;

a plurality of chamber walls which, in conjunction with said top chamber wall, enclose a cooking cavity, one of said chamber walls having a door allowing for ingress of food;

a means for generating microwaves in said cooking cavity;

a mixer shaft received through said top chamber wall and extending into said cooking cavity, said shaft being capable of rotational movement about its longitudinal axis;

a motor having an annular rotatable means;

a drive reel coaxially coupled to said mixer shaft for rotating with said shaft, said drive reel having a hub;

belt means for coupling said drive reel hub belonging to the mixer shaft for rotational movement with the rotatable means belonging to the motor; and means for supporting said mixer shaft to restrict non-rotational movement thereof, including a plurality of discs disposed around the periphery of said drive reel hub belonging to the mixer shaft, at least one disc abutting the periphery of said reel hub and at least one other disc abutting said belt means around said reel hub, each of said discs being rotatably mounted on a mounting axle, each mounting axle being mounted upright on the outside of the top chamber wall.

7. A microwave mixer according to claim 6 wherein the means for supporting said shaft further includes a spring disposed around the shaft, one end of the spring resting on the outside of the top chamber wall and the other end of the spring supporting said annular rotatable means belonging to said shaft.

8. A microwave mixer according to claim 6 further comprising a means for abating escape of microwaves comprising a plate disposed alongside the inside of the top chamber wall which receives said shaft, said plate being attached around the periphery of said shaft so that it is rotatable therewith and extending from the periphery in directions parallel to the top chamber wall and said plate having a lip extending completely around the periphery of said shaft, said lip making continuous contact with the top chamber wall thereby enclosing a space between said plate and said top chamber wall.

9. A microwave mixer according to claim 8 wherein the means for abating escape of microwave further comprises a preform of a multiplicity of densely packed metal fibers disposed in the space enclosed by said plate and the top chamber wall which receives said shaft, said preform being substantially opaque to microwaves generated in the cooking cavity.

10. A microwave mixer according to claim 9 wherein said plate is constructed of stainlesss steel.

* * * * *